United States Patent [19]

Fryrear

[11] 4,041,624

[45] Aug. 16, 1977

[54] INTEGRAL RIPPERS FOR HYDRAULIC EXCAVATOR BUCKET

[75] Inventors: Max Dennis Fryrear, Joliet, Ill.

[73] Assignee: Caterpillar Tractor Co., Peoria, Ill.

[21] Appl. No.: 461,608

[22] Filed: Apr. 17, 1974

[51] Int. Cl.[2] ..... E02F 3/76

[52] U.S. Cl. ..... 37/117.5; 37/DIG. 3; 214/145 R; 299/67

[58] Field of Search ..... 37/117.5, 118 R, 118 A, 37/DIG. 3, 141 R, 141 T, 103; 214/145, 1 E, DIG. 5; 299/36, 37, 38, 64, 67, 25, 26; 172/777, 778

[56] References Cited

U.S. PATENT DOCUMENTS

| | | | |
|---|---|---|---|
| 2,783,558 | 3/1957 | Morgan | 37/117.5 X |
| 2,840,931 | 7/1958 | Appel | 37/117.5 |
| 2,952,929 | 9/1960 | Lindberg | 37/117.5 UX |
| 3,038,267 | 6/1962 | Helton et al. | 172/777 |
| 3,039,210 | 6/1962 | Slaughter | 37/141 T X |
| 3,061,123 | 10/1962 | Rogers | 37/DIG. 3 |
| 3,097,439 | 7/1963 | Calkin | 37/117.5 |
| 3,596,996 | 8/1971 | Carter | 299/67 X |
| 3,702,712 | 11/1972 | Cairns | 299/67 |
| 3,778,111 | 12/1973 | Ciofani | 299/37 X |

*Primary Examiner*—Clifford D. Crowder
*Attorney, Agent, or Firm*—Phillips, Moore, Weissenberger, Lempio & Majestic

[57] ABSTRACT

An excavator bucket includes a pair of guide socket structures, each positioned inwardly of and adjacent a sidewall and the rear wall of the bucket. A pair of ripper shanks are included, one associated with each of the guide sockets, to be extended and retracted relative to the bucket. Each ripper shank may be selectively held in a retracted or an extended position relative to the bucket, and may be completely removed from the bucket if desired.

10 Claims, 5 Drawing Figures

Fig-3-
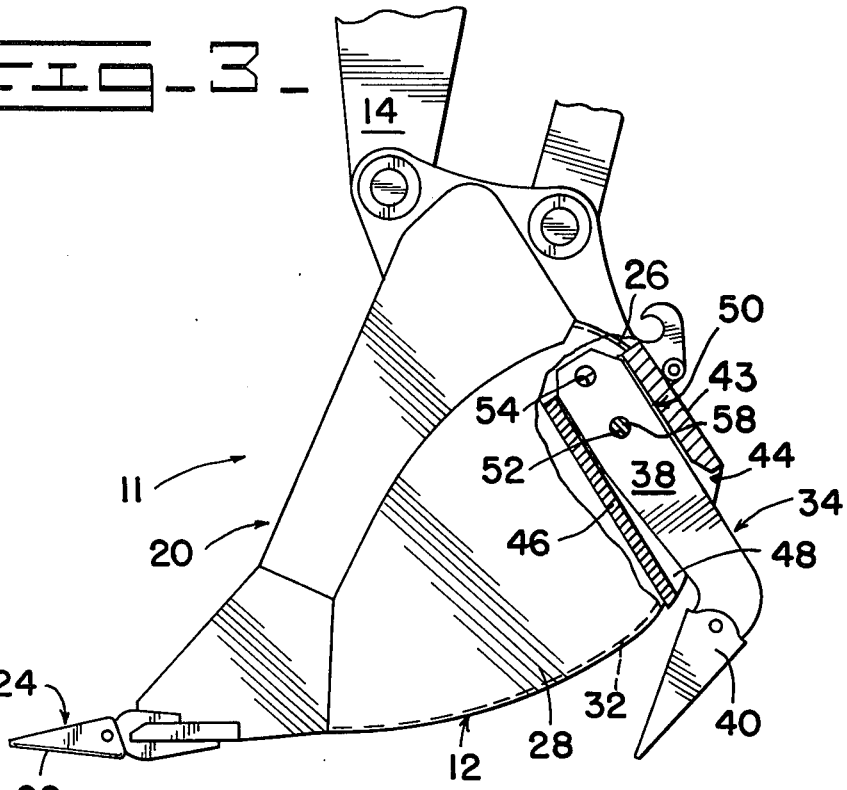
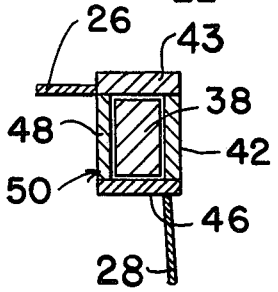
Fig-5-
Fig-4-
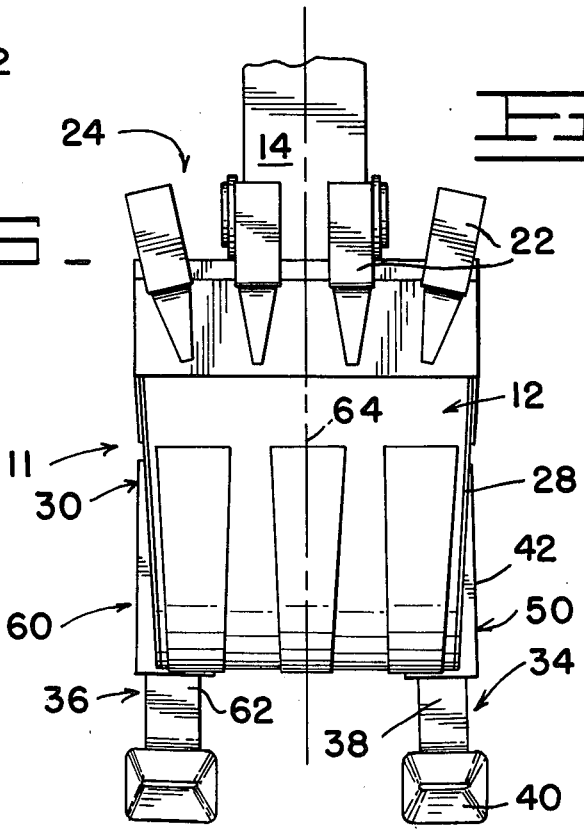

INTEGRAL RIPPERS FOR HYDRAULIC EXCAVATOR BUCKET

BACKGROUND OF THE INVENTION

This invention relates to excavator bucket structure, and more particularly, to such a bucket which includes a pair of adjustable ripper assemblies built into the rear of the bucket.

The hydraulic excavator is an extremely versatile construction machine and is used in a variety of applications, such as trenching, excavating, and general construction operations. Hardened teeth are generally added to the cutting edge portion of the bucket to aid in penetrating hard or rock-filled earth. In extremely severe applications, the machine operator will sometimes operate the bucket in a chopping-type manner. This is extremely hard on the machine and machine components, and often reduces the overall life of the bucket and related components.

In an attempt to overcome this problem, various types of ripper assemblies have been added to the bucket in various locations. The most common location is one on the rear of the bucket, such that a ripping operation takes place as the bucket is moved through the earth. In most cases, the ripper or rippers are added to the back of the bucket as an attachment, by welding various types of plates and/or supports to accept the ripper shanks. The ripper shanks are generally pinned in some manner to this auxiliary structure such that they can be removed when the machine operator desires that no ripping takes place.

U.S. Pat. Nos. 3,061,123 (Rogers), 3,596,996 (Carter), and 3,702,712 (Cairns) show various ripper structures for use on backhoe buckets. In each of these patents, the ripper structure is added as an attachment to the back of the bucket. By addition of such an attachment rather than building such structure into the bucket itself, the strength of the ripper assembly would appear not to be maximized. In each case, a large moment arm is generated by the distance from the ripper tip to the attachment of the ripper shank to the assembly. When ripping, this moment arm can generate a great deal of torsion or bending which can cause overstressing of the ripper shank or mounting structure connected thereto. Such overstressing may often lead to early failure of the structure.

SUMMARY OF THE INVENTION

It is accordingly an object of this invention to provide attachment means as part of a bucket, such attachment means being used for mounting ripper means to the bucket.

It is a further object of this invention to provide attachment means for a bucket which, while fulfilling the above object, are not of the add-on or attachment type, as disclosed in the prior art cited above, but are built into the bucket as an integral part thereof.

Broadly stated, the ivention is in combination with a bucket having a front end adapted for scooping material, a rear wall, and first and second sidewalls. The invention comprises a ripper shank positionable between the first and second sidewalls and forwardly of the rear wall and adjacent the rear wall, and extending from the bucket along the rear wall through an opening defined by the bucket. Guide means are associated with the bucket, the ripper shank being movable along the guide means to a first position extended relative to the bucket, and a second position retracted relative to the bucket. Means are associated with the guide means and with the ripper shank for holding the ripper shank in said first position, and in said second position.

BRIEF DESCRIPTION OF THE DRAWINGS

These and other objects of the invention will become apparent from a study of the following specification and drawings, in which:

FIG. 3 is a view similar to that of FIG. 2, with portions broken away;

FIG. 4 is a view taken along the line IV—IV of FIG. 1; and

FIG. 5 is a sectional view taken along the line V—V of FIG. 2.

DESCRIPTION OF THE PREFERRED EMBODIMENT

Figure 1:
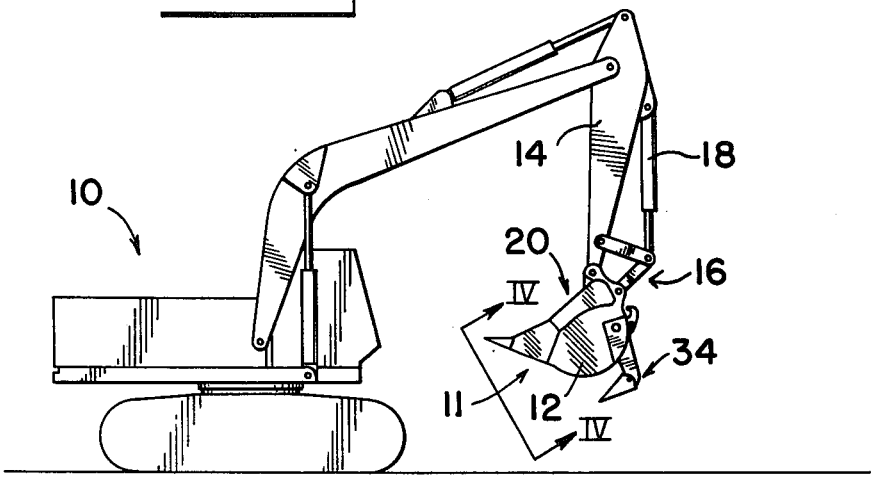
FIG. 1 is a side elevational view of a hydraulic excavator including a bucket incorporating the present invention.

Shown in FIG. 1 is a hydraulic excavator 10 which includes a bucket assembly 11 including a bucket 12 manipulatable by standard machine components which include a stick 14, linkage assembly 16, and hydraulic cylinder 18. The bucket 12 includes an open front end 20 adapted for scooping operations, and a plurality of teeth 22 protruding from the cutting edge 24 disposed thereacross. The bucket 12 includes a rear wall 26, sidewalls 28,30, and a bottom wall 32. A pair of ripper assemblies 34,36 (FIG. 4) are associated with the bucket 12 on either side thereof, each being positioned between the sidewalls thereof. The ripper assembly 34 and associated structure are most clearly shown in FIG. 3. Such ripper assembly 34 includes a ripper shank 38, and a ripper tip 40 secured to the lower end of the shank 38. The sidewall 28 of the bucket 12 includes as a part thereof a wall portion 42 and rear wall 26 includes as a part thereof a rear wall portion 43. The shank 38 is positioned inwardly of and adjacent the wall portion 42 of the sidewall 28 and in close proximity thereto, and forwardly of the rear wall portion 43 and adjacent thereto and in close proximity thereto.

Figure 2:
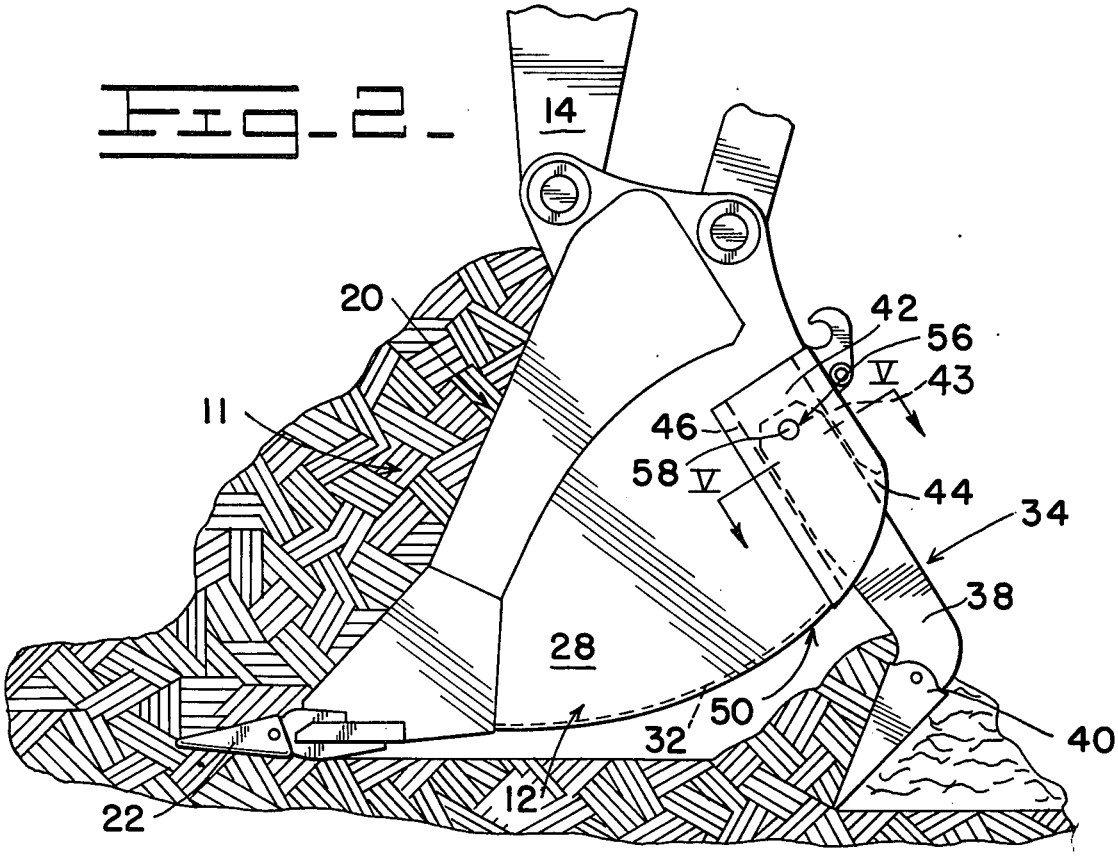
FIG. 2 is an enlarged elevational view of the bucket incorporating the invention, with the assembly shown working in an excavation.

The bucket 12 defines an opening 44 through which the ripper shank 38 extends. Fixed to the sidewall 42 forwardly of the rear wall portion 43 is a forward wall 46, and fixed to both the forward wall 46 and rear wall portion 43 is an inner wall 48 (FIGS. 3 and 5). The wall portion 42, rear wall portion 43, forward wall 46, and inner wall 48 together define a first socket assembly 50 which acts as guide means for guiding the movement of the shank 38 as it is moved to a first position relatively extended from the bucket 12 (FIG. 2), and a second position retracted relative to the bucket 12 (FIG. 3).

Means are included for selectively holding the shank 38 in its first position, and in its second position. That is, the shank 38 defines apertures 52,54 therethrough, and the shank 38 may be moved relative to the bucket 12 to bring aperture 52 into registry with a pair of aligned apertures 56 defined by the sidewall portion 42 and inner wall 48 respectively. A pin 58 is then inserted through these three aligned apertures, whereby the ripper shank 38 is secured in such position. Upon removal of the pin 58, the ripper shank 38 may be moved to bring the other aperture 54 into registry with the aligned apertures 56 in the sidewall portion 42 and the inner wall 48, and the pin 58 may be inserted in these three aligned apertures to hold the ripper shank 38 in such relatively extended position.

The ripper shank 38 may be completely removed from the bucket 12 if desired by removal of the pin 58 and sliding of the shank 38 completely outwardly of the socket assembly 50 and away from the bucket 12.

It will be understood that a like socket assembly 60 is associated with the ripper shank 62 of ripper assembly 36, and that in fact such socket assembly 60 is structurally a mirror image of the socket assembly 50 previously described, such additional socket assembly 60 being, of course, disposed on the other side of the bucket 12 and associated with the sidewall 30.

As shown in FIG. 4, the socket assemblies 50,60 are positioned and angled so that the wall portions of the sidewalls are angled outwardly relative to the vertical axis 64 of the bucket 12 in a downward direction, and the first ripper shank 38 extends from the bucket 12 outwardly to an extent relative to the vertical axis 64 of the bucket 12, and the second ripper shank 62 extends from the bucket 12 outwardly to an extent relative to the vertical axis 64 of the bucket 12. With the first and second ripper shanks 38,62 in their first, or relatively extended, positions, the overall distance determined by the extended ends of the ripper shanks 38,62 is generally equal to the overall width of the cutting edge 24. Such particular positioning and angling of the wall portions helps to prevent wedging of the assembly in an excavated trench. Such wedging is prevented since only a small portion of the ripper tips are in contact with the sidewalls of the trench, rather than the entire tips and sidewall portions.

In view of the adjustable feature offered by the two apertures in each shank, shallow ripping or deep ripping can be provided. Should an operator desire no ripping at all, the shanks can be removed from the socket assemblies. With the shanks removed, the profile of the bucket 12 becomes that of a standard bucket.

With the ripper shanks 38,62 in their retracted positions, as shown in FIG. 3, ripping may still be accomplished and in fact a higher tip ripping force is obtained than with the shanks 38,62 extended. With such shanks 38,62 retracted, extremely hard material can be successfully ripped.

What is claimed is:

1. In combination with a bucket having a front end adapted for scooping material, a rear wall, and first and second sidewalls, the improvement comprising a ripper shank positioned between the first and second sidewalls and forwardly of the rear wall and adjacent the rear wall, and extending from the bucket along the rear wall generally parallel thereto through an opening defined by the bucket rearwardly of the front end adapted for scooping material, and guide means associated with the bucket, thr ripper shank being movable along the guide means to a first position extended relative to the bucket, and a second position retracted relative to the bucket, and means associated with the guide means and ripper shank for holding the ripper shank in said first position and in said second position.

2. The combination of claim 1 wherein the ripper shank is removable from the bucket.

3. In combination with a bucket having a front end adapted for scooping material, a rear wall, and first and second sidewalls, the improvement comprising first and second ripper shanks, the first ripper shank positioned inwardly of the first sidewall and adjacent thereto, and forwardly of the rear wall and adjacent thereto, and extending from the bucket through a first opening defined by said bucket rearwardly of the front end adapted for scooping material, the second ripper shank positioned inwardly of the second sidewall and adjacent thereto, and forwardly of the rear wall and adjacent thereto, and extending from the bucket through a second opening defined by the bucket rearwardly of the front end adapted for scooping material, first guide means associated with the bucket, the first ripper shank being movable along the guide means to a first position extended relative to the bucket, and a second position retracted relative to the bucket, and means associated with the first guide means and first ripper shank for holding the first ripper shank in its first position, and in its second position and second guide means associated with the bucket, the second ripper shank being movable along the second guide means to a first position extended relative to the bucket, and a second position retracted relative to the bucket, and means associated with the second guide means and second ripper shank for holding the second ripper shank in its first position, and in its second position.

4. The combination of claim 3 wherein the first guide means comprise a first socket assembly comprising a portion of the first sidewall and a portion of the rear wall, and first additional wall means secured relative to the first sidewall and rear wall, and wherein the second guide means comprise a second socket assembly comprising a portion of the second sidewall and a portion of the rear wall, and second additional wall means secured relative to the second sidewall and rear wall.

5. The combination of claim 3 wherein the first and second ripper shanks are removable from the bucket.

6. The combination of claim 3 wherein the first ripper shank extends from the bucket outwardly to an extent relative to the vertical axis of the bucket, and the second ripper shank extends from the bucket outwardly to an extent relative to the vertical axis of the bucket.

7. The combination of claim 6 wherein the bucket includes a cutting edge thereacross, and wherein, with the first and second ripper shanks in their respective first positions, the overall distance determined by the extended ends of the ripper shanks is generally equal to the overall width of the bucket cutting edge.

8. The combination of claim 6 wherein the means for holding each ripper shank in its first position comprises pin means disposable through an aperture defined by the sidewall adjacent that ripper shank and through a first aperture defined by that ripper shank, and wherein the means for holding each ripper shank in its second position comprise pin means positionable through said aperture defined by the sidewall adjacent that ripper shank and through a second aperture defined by that ripper shank.

9. A bucket assembly comprising first and second side walls, and wall means interconnecting the first and second side walls, said first and second side walls and wall means defining a bucket having an open front portion adapted for scooping material, a ripper shank supported by and extending along one of said side walls rearwardly of said open front portion adapted for scooping material, said ripper shank extending beyond said one of said side walls and having an extended end, a ripper tooth attached to the extended end of said ripper shank, and means for fixing said ripper shank to said bucket assembly.

10. A bucket assembly for an excavator including a pair of side walls connected by a bottom member, the side walls and bottom forming a material carrying apparatus, a ripper tooth including a shank portion attached to, supported by and extending generally along one of said side walls, means for attaching said ripper tooth to said bucket assembly including a member for engaging said ripper tooth to position said ripper tooth in at least one position extending through an aperture in said bottom member.

* * * * *